US005106134A

United States Patent [19]

Thau

[11] Patent Number: 5,106,134

[45] Date of Patent: Apr. 21, 1992

[54] LATCH HOUSING & STRIKER FOR BEING SECURED IN THE LATCH HOUSING

[75] Inventor: Wolfgang Thau, Concord, Canada

[73] Assignee: KTM Locks, CMT Group, Division of Magna International Inc., Concord, Canada

[21] Appl. No.: 197,301

[22] Filed: May 23, 1988

[30] Foreign Application Priority Data

Mar. 31, 1988 [CA] Canada ..... 563001

[51] Int. Cl.[5] ..... E05C 3/26

[52] U.S. Cl. ..... 292/216; 292/337; 292/DIG. 40; 292/DIG. 56

[58] Field of Search ..... 292/216, 337, 213, 342, 292/341.12, 341.13, 303, DIG. 39, DIG. 40, DIG. 41, DIG. 56, 280

[56] References Cited

U.S. PATENT DOCUMENTS

| | | | |
|---|---|---|---|
| 1,192,733 | 7/1916 | Bennett . | |
| 1,908,344 | 5/1933 | Haberstump | 292/DIG. 40 X |
| 2,100,591 | 11/1937 | Haberstump | 292/302 |
| 2,758,864 | 8/1956 | Dixon | 292/302 |
| 3,367,699 | 2/1968 | Leslie | 292/216 |
| 3,381,993 | 5/1968 | Arlauskas | 292/216 |
| 3,674,296 | 7/1972 | Wanlass et al. | 292/216 |
| 3,709,537 | 1/1973 | Kayooka et al. | 292/216 |
| 3,858,919 | 1/1975 | Kleefeldt et al. | 292/216 |
| 4,130,308 | 12/1978 | Jeovone | 292/216 |
| 4,165,112 | 8/1979 | Kleefeldt | 292/DIG. 40 X |
| 4,172,768 | 10/1979 | Cerdan | 292/216 |
| 4,219,227 | 8/1980 | Grabner et al. | 292/216 |
| 4,235,462 | 11/1980 | Torii et al. | 292/216 |
| 4,288,117 | 9/1981 | Nardi | 292/DIG. 41 X |
| 4,358,141 | 11/1982 | Hamada | 292/216 |
| 4,466,645 | 8/1984 | Kobayashi | 292/341.12 |
| 4,538,845 | 9/1985 | Yamada | 292/216 |

*Primary Examiner*—Richard E. Moore

*Attorney, Agent, or Firm*—Ivor M. Hughes; Neil H. Hughes

[57] ABSTRACT

An improved latch housing comprising a striker receiving slot or recess opening through the latch housing for receiving a striker, (the latch housing for mounting a ratchet pivotable from an open position for receiving the striker to a closed position and a pawl for locking the ratchet in the closed (locked) position, the slot or recess having a mouth and two ends and being tapered from a broader portion (near the mouth) to a narrower portion (remote the mouth) intermediate its ends, the end of the recess proximate the broader tapered portion comprising a pair of parallel spaced walls extending towards the mouth from proximate the broader portion and the end of the recess proximate the narrower portion (remote the mouth) comprising a pair of spaced walls which are parallel to one another when the striker is secured in the striker receiving recess of the latch housing. The latch housing is for use with a tapered striker.

50 Claims, 4 Drawing Sheets

LATCH HOUSING & STRIKER FOR BEING SECURED IN THE LATCH HOUSING

FIELD OF INVENTION

This invention relates to improved latch mechanisms and components therefore and particularly relates to improved striker and latch housing configurations. The latch mechanisms are suitable for use on vehicle doors for securing the door to a "B" or "C"-Pillar.

BACKGROUND OF INVENTION

Many latch mechanism proposals have been made for securing vehicular doors to the "B" or "C"-Pillars. (Two of such proposals include those shown in U.S. Pat. Nos. 4,358,141 and 4,538,845.)

Latch mechanism proposals normally include:

(a) a resiliently biased ratchet carrying a recess for receiving a striker (carried by the "B" or "C"-Pillar), the ratchet pivotable from an open position for receiving the striker to a closed position for locking the door to the "B" or "C"-Pillar, (b) a pawl for locking the ratchet in a locked position, (c) a release lever for releasing the pawl for releasing the ratchet to pivot to the open position (by for example lifting the inside or outside release handle) and (d) a locking lever for precluding a release lever from releasing the pawl.

Because of the downsizing of cars, collisions of the smaller vehicles with other vehicles may have greater structural deformation of the component parts making up these vehicles, than the larger ones and more serious consequences may result. In some instances, the latch mechanism securing the door to the striker detaches from the striker and the door opens.

During normal use of the vehicle when driving, the body of the car flexes and thus the components flex relative to one another. Flexing occurs between the striker and the latch housing in which it is secured.

When latching the striker in a housing, four types of movement may occur and must be accounted for when securing the striker:

(a) vertical motion of the striker relative to the latch housing (up and down)

(b) lateral motion of the striker relative to the housing (into and out of the body cell)

(c) forward and backward motion of the striker relative to the housing and (d) torsional movement of the striker relative to the latch housing.

If any of these types of motion are not accounted for, an "inferior" design will occur.

In the most common vehicle door latch design wherein the striker comprises a substantially cylindrical shank having a head of extended diameter at the end thereof, the head portion and shank sliding into a horizontally extending slot disposed within the door closed at one end, the ratchet encouraged to rotate by said striker, thereby engaging the shaft behind the head of the striker and thereby preventing the striker from exiting the slot. However, the latch does not rigidly hold the door closed as there is a certain amount of free play resulting in rotating of the door in time. Such rotational forces are usually not in a single plane, and the tendency during a collision is for either the head of the striker to partially or totally shear away from the locking engagement with the ratchet or the ratchet will bend, buckle and twist, thereby disabling the mechanism. Examples of such vehicle door locks may be seen in U.S. Pat. Nos. 3,674,296; 4,130,308; 4,357,039; 4,358,141 and 3,367,699.

In an effort to compensate for the rotation of the ratchet relative to the striker in a collision it is known to provide a striker having a structure which is tapered in one axis. Such a "wedge shaped" striker is mounted on a vehicle pillar. The wedge shape is generally horizontally inclined with the smaller cross section of the wedge leading the advance of the striker into a slot for engagement thereat with a ratchet. An example of a wedge shaped striker may be seen in U.S. Pat. Nos. 4,165,112 and 4,219,227. As appears from U.S. Pat. No. 4,219,227 a ratchet engages a depression in the wedge shaped striker. As appears from U.S. Pat. No. 4,165,112 the striker has a hole through it, through which a leg of a U-shaped ratchet passes when the mechanism is engaged. It will be appreciated by those skilled in the art that such an arrangement would tend to prevent rotation of the striker in relation to the housing therefor.

Further it will be appreciated by those skilled in the art that proper engagement of the ratchet with the hole in the striker is very necessary. To this end, such a mechanism requires careful design and installation which ensures in continuous use that when the door is closed, the ratchet will be aligned with the hole in the striker for engagement therewith. Various bumpers, guides and elastomeric devices have been proposed to assist such an alignment. In U.S. Pat. No. 4,219,227 and in an older U.S. Pat. No. 3,858,919 a cone shaped pin is mounted in the slot receiving the door striker. The door striker has a cone shaped recess which slideably fits over the cone shaped pin when the door striker is engaged in the slot for locking. It will be appreciated by those skilled in the art that while the foregoing mechanisms may provide for proper alignment with the aid of bumpers, elastomeric devices and shims during installation and further such a device may assist in reducing rotation in a plane perpendicular to the axis of the door striker, the mechanism will still permit longitudinal separation of the striker from the slot in a longitudinal direction in for example the axis of the striker extending away from the pillar generally in the lengthwise direction of the car. Furthermore, because of the design tolerances required it is likely that any deformation of the locking mechanism components concomitant with a collision will cause jamming, resulting in difficulty for a passenger to release the locking mechanism in order to leave the car.

It is known in the art to provide an engagement between a striker and a slot for receiving the striker which will resist the longitudinal separation of the striker from the slot for receiving same. For example, U.S. Pat. Nos. 1,192,733 and 2,100,591 disclose a "hook shaped" striker. The hook or projection of the striker fits into a slot which is generally U-shaped and surrounds the hook, thereby preventing longitudinal separation. In the latter U.S. Pat. No. 2,100,591, a bolt slides internally of the U-shaped slot for engaging a corresponding aperture in the hook. In this manner, the hook cannot slide out of the recess.

In U.S. Pat. No. 2,758,864 a locking mechanism is disclosed wherein the striker is generally T-shaped in cross section and may be slidingly keyed into a slot having the same T-shaped cross section. The leading edge of the striker having a T-shaped cross section is formed with a cam surface for displacing a spring biased latch bolt which may slideably enter the slot. When the door is closed the cam surface of the striker raises the latch bolt. The latch bolt passes over the striker to the back of the striker and blocks its exit from the slot. It will be appreciated by those skilled in the art that such an arrangement is similar in principle to the traditional arrangement of a striker pin engaging a pivotable ratchet which once engaged blocks the exit of the striker pin from the slot.

In United Kingdom Patent 239,691 there is provided a latching mechanism for use in a motor vehicle wherein the "striker" slidingly engages a slot in a latch housing. The striker is of a generally T shaped cross-section—the head of the striker is tapered in two directions, being wider at the base than the leading edge and has a transverse taper from the base at the back, to the front. The neck of the striker is also tapered, being wider proximate the base than the leading edge. The slot is tapered in two directions comprising a "V" shaped taper matching that of the neck of the striker and a transverse taper matching the transverse taper of the head of the striker. The combination of the transverse taper of the striker head and the transverse taper of the slot draws the striker and the latch housing together when placed in engagement. It will be appreciated by those skilled in the art that the transverse taper is not symmetrical. Exact alignment of the striker with the slot is therefore required during design and installation thereof.

In U.S. Pat. No. 4,466,645 a U-shaped striker is disclosed having a part covered by a mould-formed plastics material, the portion of which carried at the juncture of one corner of the horizontal connector and leg which is pushed into a door latch being thicker, to present a columnar shape.

It is also desirable to minimize the closing efforts of the striker into the latch housing. In some instances where rubber or elastomeric bumpers are provided in the striker receiving recess of the latch housing, the engagement of the striker with the walls and bumpers of the striker receiving recess increases the effort to insert the striker deeper into the recess because of the jamming effect. This is magnified where there exists wide ranges of tolerance between the striker and wall and bumpers in the recess.

In my Canadian Application Serial Number 525,664, I disclosed tapered strikers.

It is therefore an object of this invention to provide an improved latch housing and components therefor.

It is a further object of the invention to provide an improved latch housing - striker combination which has enhanced safety characteristics should an accident occur.

It is still a further object of the invention to provide a quieter latch housing and striker combination.

It is a further object of the invention to provide a latch housing - striker combination which minimizes the closing effort of securing the striker in the latch receiving recess of a latch housing.

It is a further object of the invention to provide support against door sag in the door "ajar" position (or "secondary position").

Further and other objects of the invention will be realized by those skilled in the art from the following summary of the invention and detailed description of embodiments thereof.

SUMMARY OF INVENTION

According to one aspect of the invention, an improved latch housing is provided, the latch housing comprising a striker receiving slot or recess opening through the latch housing for receiving a striker, (the latch housing for mounting a ratchet pivotable from an open position for receiving the striker to a closed position and a pawl for locking the ratchet in the closed (locked position) the slot or recess having a mouth and two ends and being tapered from a broader portion (near the mouth) to a narrower portion (remote the mouth) intermediate its ends, the end of the recess proximate the broader tapered portion comprising a pair of parallel spaced walls (preferably parallel spaced horizontally extending walls) extending towards the mouth from proximate the broader portion and the end of the recess proximate the narrower portion (remote the mouth) comprising a pair of spaced walls which are parallel to one another when the striker is secured in the striker receiving recess of the latch housing.

In one embodiment one of the walls of pair of spaced walls at the end of the recess proximate the narrower portion is deflectable away from the other wall to become parallel therewith when the striker is secured in the striker receiving recess.

In another embodiment one of the walls of a pair of spaced walls at the end of the recess proximate the narrower portion is carried on a slideable portion or shoe which wall is moved to a position opposite the other wall.

The end of the recess or slot remote the mouth preferably carries a soft plastic or soft elastomeric bumper for being engaged by the leading edge of the striker.

According to another aspect of the invention there is provided a latch housing striker combination for a vehicle door locking mechanism, the latch housing as previously described the striker comprising a head and a base, the head carrying sloping sides tapered (preferably symmetrically tapered) in at least one direction (preferably in two directions) from a broad portion towards an apex directed to enter the latch housing, the head of the striker also comprising a flat portion extending in a direction away from the apex away from the broad portion, whereby when the striker is secured in the slot, (a) the elastomeric material (where provided) to be compressed (at the end of the recess or slot remote the mouth) is compressed (b) (where provided) the wall proximate the narrower portion is deflected into a parallel position with the opposite wall and (c) (where provided) the wall on the slideable portion is slid to a position parallel and directly opposite the other wall, the broad portion of the tapered portion of the striker engages the parallel walls at the mouth of the slot or recess and the flat end at the end of the striker engages between the parallel walls at the end of the recess remote the mouth thereby securing the striker against torsional motion and vertical (up and down) motions of the door in which the latch housing is mounted.

According to a preferred embodiment of the invention the striker head carrying the sloping sides is symmetrically tapered in at least two directions towards an apex and is of a generally frustum trapezoidal configuration.

According to another aspect of the invention, the striker is provided comprising two rectangular portions each having two opposed end edges carrying a mounting aperture and a latch-receiving aperture for receiving a latch, the two rectangular portions each being bent intermediate their end edges and disposed normal (substantially 90 degrees) to one another, the portion between the edge of the latch-receiving aperture remote the bent and closed end edge to the latch-receiving aperture is curved laterally in a direction away from the plane of the bent portion containing the latch-receiving aperture in a direction towards the portion containing the mounting aperture whereby when the two portions containing the latch-receiving aperture are aligned and joined together, the end of the striker provides two laterally-extending curved portions (preferably symmetrical laterally extending portions) tapered towards an apex directed for centering a latch housing. Preferably two pairs of two laterally extending curved portions (preferably symmetrical laterally extending portions) are provided.

According to another aspect of the invention the curved portion is tapered from a wider section to a narrower portion towards the apex provided for entering a latch housing.

According to another aspect of the invention, the striker may comprise a U-shaped member comprising a pair of legs anchored to a base and a connector rod connecting the legs, the connector comprising the head carrying the tapered portions.

According to another aspect of the invention, the striker provides to present two sides symmetrically tapered in at least two directions towards an apex directed for entering a latch housing.

According to another aspect of the invention, the striker may present two sides symmetrically tapered in at least one direction (and preferably two directions) towards an apex.

The invention will now be illustrated with reference to the following drawings of embodiments of the invention and detailed description thereof.

DETAILED DESCRIPTION OF A PREFERRED EMBODIMENT OF THE INVENTION

Figure 1:
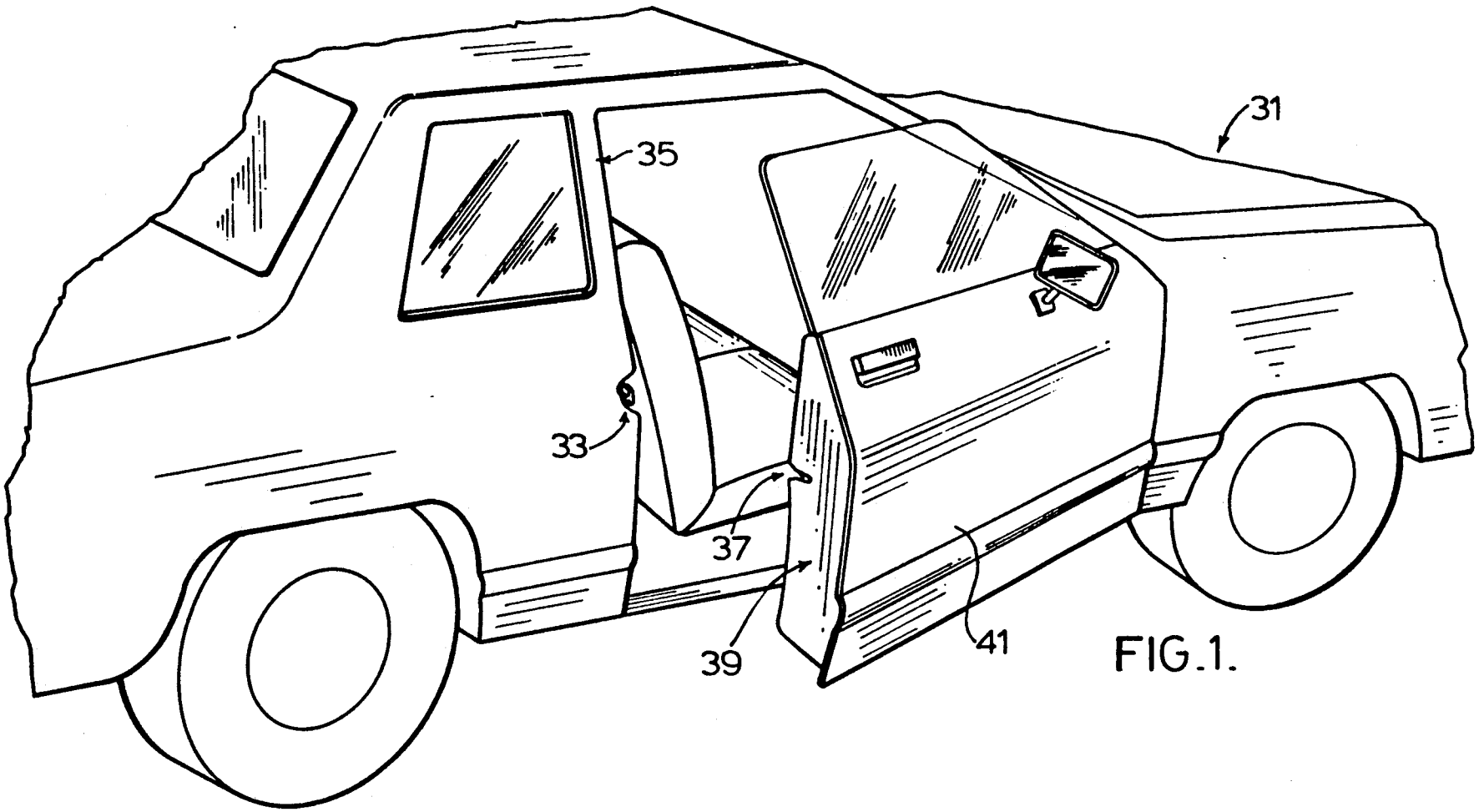
FIG. 1 is a perspective view of a vehicle and its right front door comprising a striker mounted on a pillar and a slot in a door mounted latch housing for receiving the striker.

With reference to FIG. 1 there is shown the right side of a vehicle 31, comprising a symmetrically tapered striker 33 mounted on a pillar 35 and slot 37 in the end face 39 of a door 41. The slot 37 comprises a mouth 38 leading into one of latch housings 43 and 43A (best seen in FIGS. 4 through 8 inclusive) for receiving the striker 33.

Figure 3:
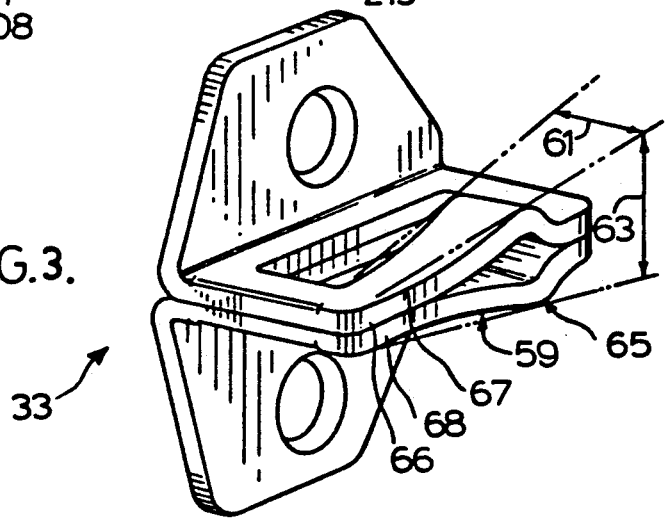
FIG. 3 is a perspective view of another striker tapered in two directions.

Referring to FIG. 3 there is shown a preferred embodiment of the striker 33, having a head 59 which is symmetrically tapered in two directions 61, 63 of a generally frustum trapezoidal configuration. All that is necessary is that the height 63 and width 61 of the striker 33 is symmetrically tapered and are greater proximate the rear end 65 than proximate the apex 67 (forward end). Extending forwardly from apex 67 away from rear end 65 is abutting flat portions 66 and 68 which extend for about 9 mm each to provide a flat planar portion (see FIG. 8).

Figure 2:
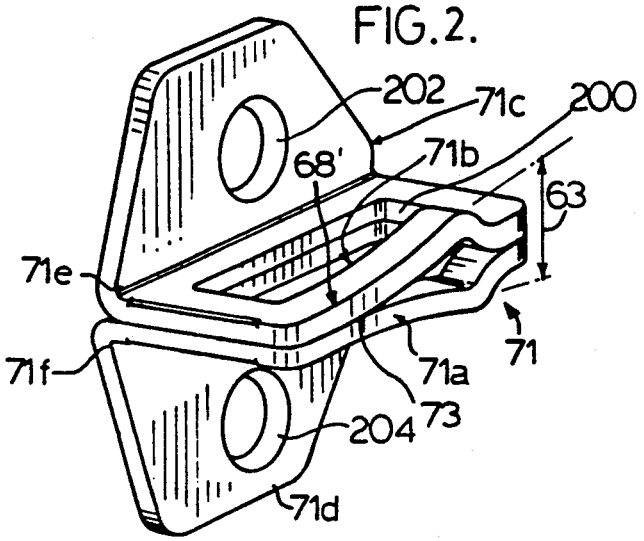
FIG. 2 is a perspective view of a striker tapered in one direction.

FIG. 2 shows a striker 71 tapered in one vertical direction 63 to an apex 73. The walls 71*a*, 71*b* of the striker 71 oriented in the horizontal axis are parallel one 71*a* to the other 71*b*. Striker 71 also carries flat abutting planar portions 66' and 68' of 9 mm in length like portions 66 and 68.

Striker 71 (like striker 33) comprises two rectangular portions 71*c* and 71*d* bent at 71*e* and 71*f* intermediate its ends and joined together presenting latch-receiving aperture 200 and mounting apertures 202 and 204. Walls 71*a* and 71*b* have been stamped in a manner to provide two symmetrically laterally extending curved stamped portions tapered towards apex 206 (directed for entering a latch housing). The striker shown in FIG. 3 is similar in construction to the striker in FIG. 2 except that two other sides of the striker are symmetrically tapered in another direction as shown towards apex 73.

Figure 4:
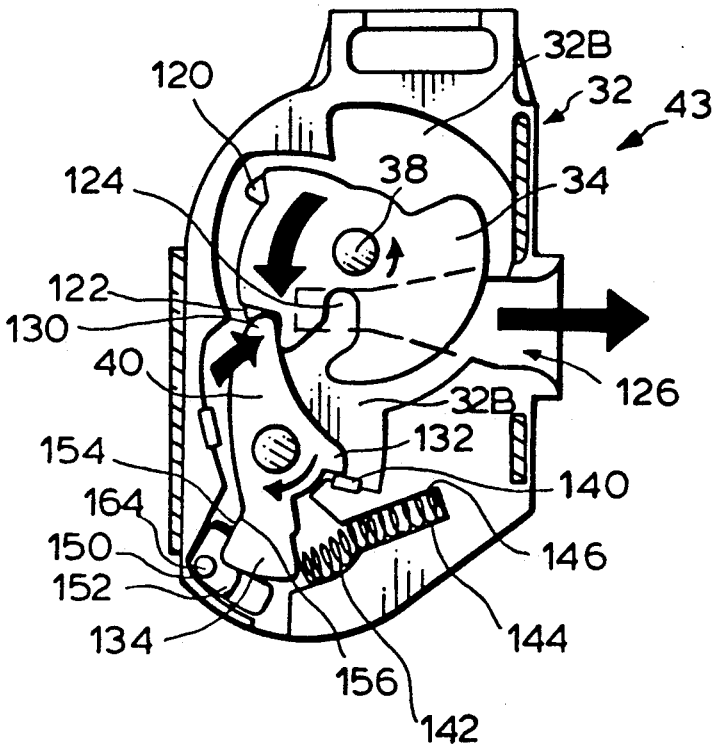
FIG. 4 is a schematic side view of a latch housing comprising a ratchet and pawl.

With reference to FIG. 4, latch housing 43 mounts pawl 40 and ratchet 34 (covered by plastics material except at shoulders 120 and 122 on the side of striker receiving recess 124 remote striker receiving slot, recess or opening 126 in latch housing 43. Shoulders 120 and 122 are provided for engaging 130 of pawl 40. Raised portions 132 and 134 of pawl 40 are provided for abutting wall portion of the recess in which the ratchet 34 and pawl 40 are pivotally mounted as for example, at 140 which is a soft plastics bumper secured to the tough, rigid plastics material of housing 43 for silencing the movement of the pawl 40. Shoulder of pawl 134 engages the end 142 of compression spring 144, riding in groove 146 also for noise reduction purposes when the pawl pivots.

Figure 5:
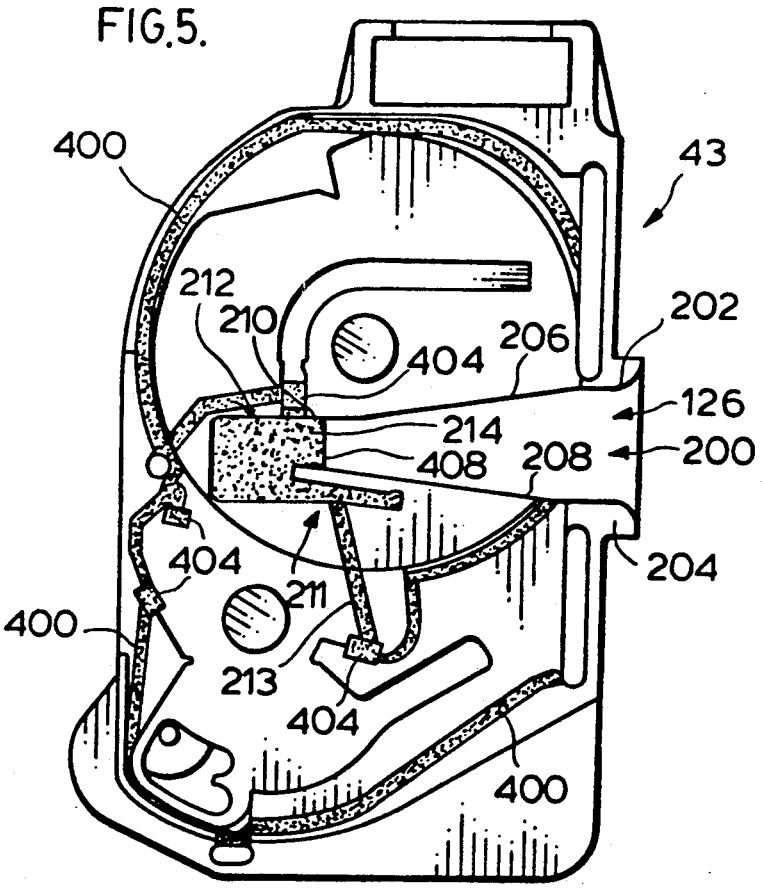
FIG. 5 is a side view of the latch housing shown in FIG. 4.
Figure 6:
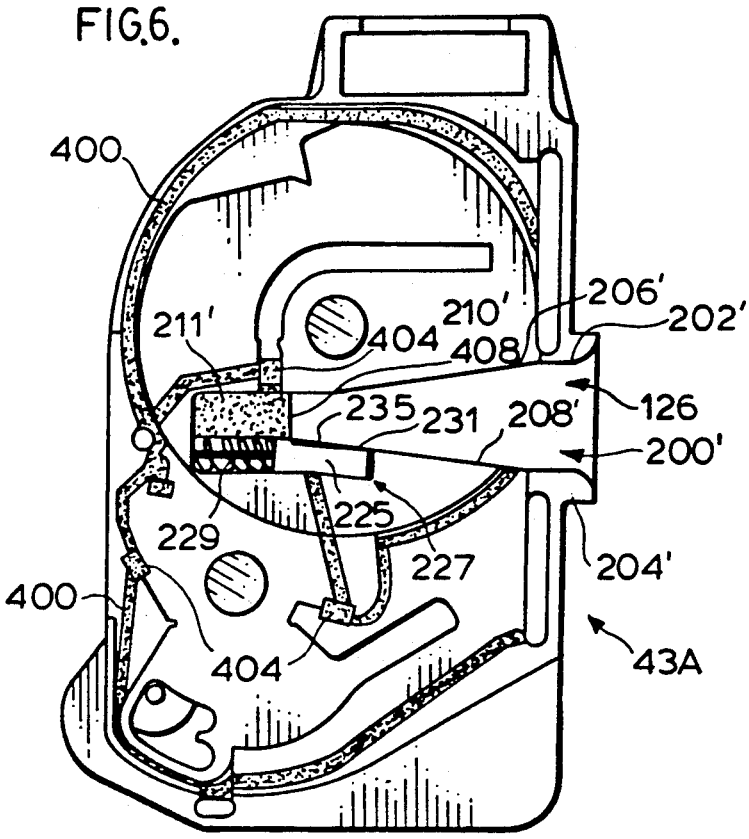
FIG. 6 is a side view of another latch housing according to another embodiment.

With reference to FIGS. 5 and 6, there is shown a detailed configuration of the housing 43 which has been injection moulded from an acetal plastics material (for example, Delrin t.m. of Dupont). Striker receiving slot, recess or opening 126 comprises mouth 200 at one end, a pair of parallel, horizontally extending spaced walls 202 and 204 proximate mouth 200, and spaced tapered wall portions 206 and 208 extending from walls 202 and 204. Wall 206 terminates at horizontally extending wall 210 (see FIG. 8). Wall 208 extends to sloped portion 208A (see FIG. 5) which overlies a channel or recess or slot 211 carrying compressible soft plastics material 213 ("Hytrel"). Recess 126 at its end 212 remote mouth 200 carries compressible soft plastics material 214 ("Hytrel") to act as a shock absorber. Injection moulded housing 43 also carries other recesses into which softer plastics material ("Hytrel") shown in stippled line in FIG. 5 has been injection moulded (including portions 213 and 214) which are to comprise silencers, noise reducers, sealing portions, and bumpers (including shock absorbers). The addition of the silencers, noise reducers, sealing portions and bumpers has been carried out in a one-step operation. Each of the added components in the recesses shown were made at the same time as the others by injection moulding techniques. Thus, raised sealing surface 400 made of softer "Hytrel" plastics has been injection moulded into thin recesses 402 provided in housing 43 before the injection moulded step. Bumpers and silencers have been provided as for example, at 404 injection moulded in recesses 406 and shock absorber 214 has been injection moulded in portion 212 of housing 43 against which the striker engages.

Figure 7:
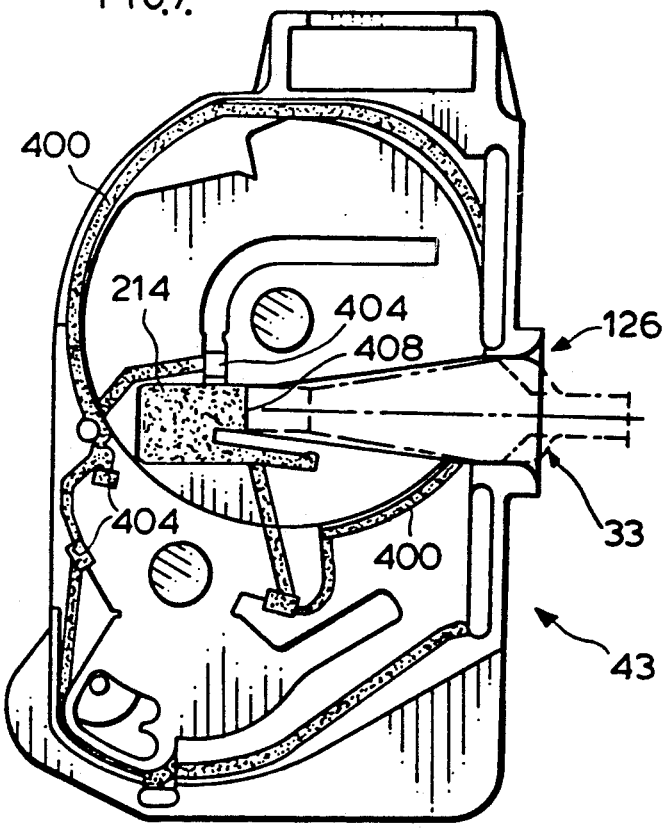
FIG. 7 is a side view of a striker being secured in the latch housing of FIG. 5 according to an embodiment of the invention.

Housing 43A (see FIG. 6) is similarly constructed to housing 43 except that sloped extension 208A, channel 211 and compressible material 213 are replaced by shoe 225 riding in channel 227 from proximate the end of tapered wall 208' opposite wall 206' against the action of compression spring 229 but being normally maintained in the position shown in FIG. 7.

Shoe 225 carries sloped tapered portion or wall 231 (which is a continuation of surface 208') and extends to horizontally extending wall portion 233. At the end of wall portion 233 is step 235 (rising towards opposite horizontal wall 210' by riser 237 secured to horizontal tread 239. Any rearward pressure brought to bear on riser 237 in a direction away from mouth 200' causes shoe 225 to slide rearwardly away from mouth 200', aligning horizontal wall portion 233 with wall 210' until such time as the pressure is removed.

Figure 8:
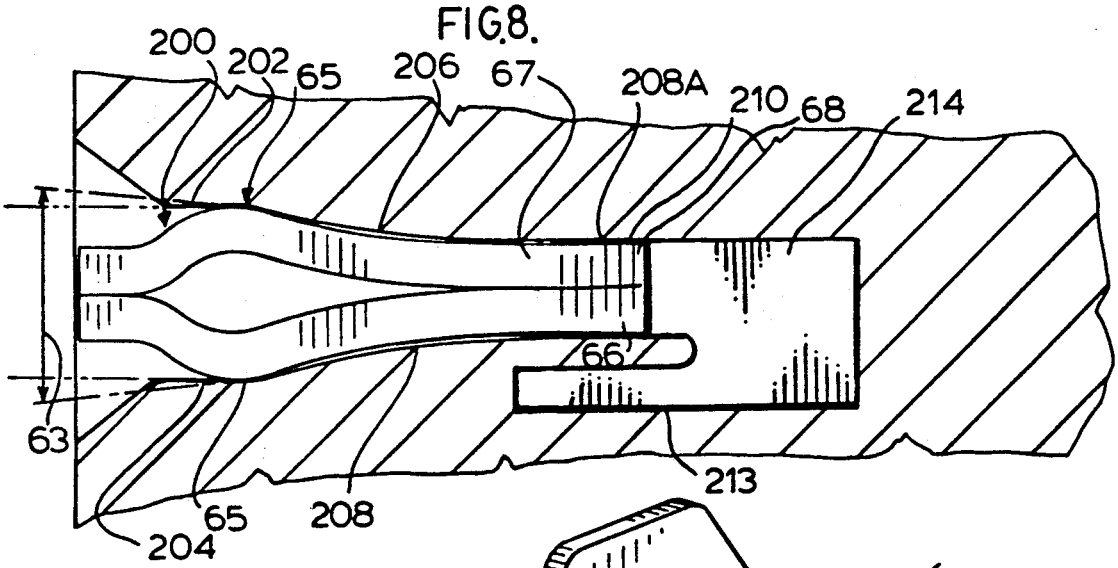
FIG. 8 (shown with FIGS. 2 and 3) is a close-up view of part of the structure shown in FIG. 7 looking from the opposite direction into the striker receiving recess only (with the remaining components removed).

With reference to FIGS. 7 and 8, striker 33 or 71 is inserted into slot or recess 126 through mouth 200. As the end of striker 33 or 71 engages soft material 214 (see FIGS. 7 and 8), extension 208A is depressed (onto material 213 in channel or groove 211) and is caused to be positioned horizontally parallel to flat portion 66 and 68 or 66' and 68' of strikers 33 and 71 respectively.

As is apparent from FIG. 8, portion 208A extends in the horizontal direction when it engages flat portion 66 (or 66'). Horizontal wall 210 at the same time engages flat portion 68 (or 68'). At the same time broad portion 65 of each striker 33 or 71 engages the horizontally extending walls 202 and 204 and depending on the slope of walls 206 and 208 and the sloped portions of the strikers 33 or 71, a space may be provided therebetween (see FIG. 8) to ease insertion of the striker 33 or 71 into the recess 126. Thus when the broadest portion of the striker at 65 is supported between parallel walls 202 and 204 and the leading flat portions 66 and 68 or 66' and 68' of the striker 33 and 71 are supported between the horizontally extending walls 210 and 208A, the striker is secured against torsional motion and vertical motion of the door in which the latch housing is mounted.

In a similar way when striker 33 or 71 is inserted into recess 126 of housing 43A, striker 33 or 71 easily slides into the recess 126 eventually engaging riser 237 of shoe 225 pushing it rearwardly compressing spring 229 until the end of the striker engages material 214. At that point wall 66 (or 66') lies on flat wall 233 of shoe 225 and is opposite flat wall 210' engaging wall 68 (or 68') of striker 33 (or 71) resulting in the same securing of the striker—the striker is secured against torsional motion and vertical motion of the door in which the latch housing is mounted.

As many changes can be made to the embodiments without departing from the scope of the invention, it is intended that all matter contained herein be interpreted as illustrative of the invention and not in a limiting sense.

The embodiments of the invention in which an exclusive property or privilege is claimed are as follows:

1. An improved latch housing comprising a striker receiving slot or recess opening through the latch housing for receiving a striker, (the latch housing for mounting a ratchet pivotable from an open position for receiving the striker to a closed position and a pawl for locking the ratchet in the closed (locked position)), the slot or recess having a mouth and two ends and being tapered from a broader portion (near the mouth) to a narrower portion (remote the mouth) intermediate its ends, the end of the recess proximate the broader tapered portion comprising a pair of substantially parallel spaced walls extending towards the mouth from proximate the broader portion; and the end of the recess proximate the narrower portion (remote the mouth) comprising a pair of spaced walls which are substantially parallel to one another when the striker is secured in the striker-receiving recess of the latch housing, the striker having means disposed therewith to engage the slot proximate the broader tapered portion of the slot having the pair of substantially parallel spaced walls, and proximate the narrower portion at the end of the recess (remote the mouth) having the pair of spaced walls which are substantially parallel to one another when the striker is secured in the striker receiving recess of the latch housing, the striker thus being secured against torsional motion and vertical motion of the door in which the latch housing is mounted.

2. The latch housing of claim 1, wherein the parallel spaced walls extending towards the mouth from proximate the broader portion are parallel spaced horizontally extending walls.

3. The latch housing of claim 1, wherein the pair of spaced walls which are parallel to one another when the striker is secured in the striker-receiving recess of the latch housing both extend horizontally when the striker is so secured.

4. The latch housing of claim 2, wherein the pair of spaced walls which are parallel to one another when the striker is secured in the striker-receiving recess of the latch housing both extend horizontally when the striker is so secured.

5. The latch housing of claim 1, wherein one of the walls of the pair of spaced walls at the end of the recess proximate the narrower portion is deflectable away from the other wall to become parallel therewith when the striker is secured in the striker-receiving recess.

6. The latch housing of claim 2, wherein one of the walls of the pair of spaced walls at the end of the recess proximate the narrower portion is deflectable away from the other wall to become parallel therewith when the striker is secured in the striker-receiving recess.

7. An improved latch housing comprising a striker receiving slot or recess opening through the latch housing for receiving a striker, (the latch housing for mounting a ratchet pivotable from an open position for receiving the striker to a closed position and a pawl for locking the ratchet in the closed (locked position)), the slot or recess having a mouth and two ends and being tapered from a broader portion (near the mouth) to a narrower portion (remote the mouth) intermediate its ends, the end of the recess proximate the broader tapered portion comprising a pair of substantially parallel spaced walls extending towards the mouth from proximate the broader portion; and the end of the recess proximate the narrower portion (remote the mouth) comprising a pair of spaced walls which are substantially parallel to one another when the striker is secured in the striker-receiving recess of the latch housing, wherein one of the walls of a pair of spaced walls at the end of the recess proximate the narrower portion is carried on a slideable shoe portion which wall is moved by the striker entering the recess to a position opposite the other wall.

8. The latch housing of claim 1, wherein one of the walls of a pair of spaced walls at the end of the recess proximate the narrower portion is carried on a slideable shoe portion which wall is moved by the striker entering the recess to a position opposite the other wall.

9. The latch housing of claim 1, wherein the end of the recess or slot remote the mouth carries a soft plastic or soft elastomeric bumper for being engaged by the leading edge of the striker.

10. The latch housing of claim 2, wherein the end of the recess or slot remote the mouth carries a soft plastic or soft elastomeric bumper for being engaged by the leading edge of the striker.

11. The latch housing of claim 3, wherein the end of the recess or slot remote the mouth carries a soft plastic or soft elastomeric bumper for being engaged by the leading edge of the striker.

12. The latch housing of claim 4, wherein the end of the recess or slot remote the mouth carries a soft plastic or soft elastomeric bumper for being engaged by the leading edge of the striker.

13. The latch housing of claim 5, wherein the end of the recess or slot remote the mouth carries a soft plastic or soft elastomeric bumper for being engaged by the leading edge of the striker.

14. The latch housing of claim 6, wherein the end of the recess or slot remote the mouth carries a soft plastic or soft elastomeric bumper for being engaged by the leading edge of the striker.

15. The latch housing of claim 7, wherein the end of the recess or slot remote the mouth carries a soft plastic or soft elastomeric bumper for being engaged by the leading edge of the striker.

16. The latch housing of claim 8, wherein the end of the recess or slot remote the mouth carries a soft plastic or soft elastomeric bumper for being engaged by the leading edge of the striker.

17. A latch housing-striker combination for a vehicle door locking mechansim, the latch housing as constructed in claim 1, and the striker comprising a head and a base, the head carrying sloping sides tapered in at least one direction from a broad portion towards an apex directed to enter the latch housing, the head of the striker also comprising a flat portion extending in a direction away from the apex away from the broad portion whereby when the striker is secured in the slot the broad portion of the tapered portion of the striker engages the parallel walls at the mouth of the slot or recess and the flat end at the end of the striker engages between the parallel walls at the end of the recess remote the mouth thereby securing the striker against torsional motion and vertical (up and down) motion of the door in which the latch housing is mounted.

18. A latch housing-striker combination for a vehicle door-locking mechanism, the latch housing as constructed in claim 2, and the striker comprising a head and a base, the head carrying sloping sides tapered in at least one direction from a broad portion towards an apex directed to enter the latch housing, the head of the striker also comprising a flat portion extending in a direction away from the apex away from the broad portion whereby when the striker is secured in the slot the broad portion of the tapered portion of the striker engages the parallel walls at the mouth of the slot or recess and the flat end at the end of the striker engages between the parallel walls at the end of the recess remote the mouth thereby securing the striker against torsional motion and vertical (up and down) motion of the door in which the latch housing is mounted.

19. A latch housing-striker combination for a vehicle door-locking mechanism, the latch housing as constructed in claim 3 and the striker comprising a head and a base, the head carrying sloping sides tapered in at least one direction from a broad portion towards an apex directed to enter the latch housing, the head of the striker also comprising a flat portion extending in a direction away from the apex away from the broad portion whereby when the striker is secured in the slot the broad portion of the tapered portion of the striker engages the parallel walls at the mouth of the slot or recess and the flat end at the end of the striker engages between the parallel walls at the end of the recess remote the mouth thereby securing the striker against torsional motion and vertical (up and down) motion of the door in which the latch housing is mounted.

20. A latch housing-striker combination for a vehicle door locking mechanism, the latch housing as constructed in claim 4 and the striker comprising a head and a base, the head carrying sloping sides tapered in at least one direction from a broad portion towards an apex directed to enter the latch housing, the head of the striker also comprising a flat portion extending in a direction away from the apex away from the broad portion whereby when the striker is secured in the slot the broad portion of the tapered portion of the striker engages the parallel walls at the mouth of the slot or recess and the flat end at the end of the striker engages between the parallel walls at the end of the recess remote the mouth thereby securing the striker against torsional motion and vertical (up and down) motion of the door in which the latch housing is mounted.

21. A latch housing-striker combination for a vehicle door locking mechanism, the latch mechanism as constructed as claimed in claim 5, the striker comprising a head and a base, the head carrying sloping sides tapered in at least one direction from a broad portion towards an apex directed to enter the latch housing, the head of the striker also comprising a flat portion extending in a direction away from the apex away from the broad portion whereby when the striker is secured in the slot and the wall proximate the narrower portion to be deflected into a parallel position with the opposite wall, is deflected, the broad portion of the tapered portion of the striker engages the parallel walls at the mouth of the slot or recess and the flat end at the end of the striker engages between the parallel walls at the end of the recess remote the mouth thereby securing the striker against torsional motion and vertical (up and down) motion of the door in which the latch housing is mounted.

22. A latch housing-striker combination for a vehicle door locking mechanism, the latch mechanism as constructed as claimed in claim 6, the striker comprising a head and a base, the head carrying sloping sides tapered in at least one direction from a broad portion towards an apex directed to enter the latch housing, the head of the striker also comprising a flat portion extending in a direction away from the apex away from the broad portion whereby when the striker is secured in the slot and the wall proximate the narrower portion to be deflected into a parallel position with the opposite wall, is deflected, the broad portion of the tapered portion of the striker engages the parallel walls at the mouth of the slot or recess and the flat end at the end of the striker engages between the parallel walls at the end of the recess remote the mouth thereby securing the striker against torsional motion and vertical (up and down) motion of the door in which the latch housing is mounted.

23. A latch housing striker combination for a vehicle door locking mechanism, the latch mechanism as constructed as claimed in claim 7, the striker comprising a head and a base, the head carrying sloping sides tapered in at least one direction from a broad portion towards an apex directed to enter the latch housing, the head of the striker also comprising a flat portion extending in a direction away from the apex away from the broad portion whereby when the striker is secured in the slot and the wall on the slideable portion is slid to a position parallel and directly opposite the other wall, the broad portion of the tapered portion of the striker engages the parallel walls at the mouth of the slot or recess and the flat end at the end of the striker engages between the parallel walls at the end of the recess remote the mouth thereby securing the striker against torsional motion and vertical (up and down) motion of the door in which the latch housing is mounted.

24. A latch housing striker combination for a vehicle door locking mechanism, the latch mechanism as constructed as claimed in claim 8, the striker comprising a head and a base, the head carrying sloping sides tapered in at least one direction from a broad portion towards an apex directed to enter the latch housing, the head of the striker also comprising a flat portion extending in a direction away from the apex away from the broad portion whereby when the striker is secured in the slot and the wall on the slideable portion is slid to a position parallel and directly opposite the other wall, the broad portion of the tapered portion of the striker engages the parallel walls at the mouth of the slot or recess and the flat end at the end of the striker engages between the parallel walls at the end of the recess remote the mouth thereby securing the striker against torsional motion and vertical (up and down) motion of the door in which the latch housing is mounted.

25. A latch housing striker combination for a vehicle door locking mechanism, the latch mechanism as constructed as claimed in claim 9, the striker comprising a head and a base, the head carrying sloping sides tapered in at least one direction from a broad portion towards an apex directed to enter the latch housing, the head of the striker also comprising a flat portion extending in a direction away from the apex away from the broad portion whereby when the striker is secured in the slot and the elastomeric material is compressed at the end of the recess or slot remote the mouth, the broad portion of the tapered portion of the striker engages the parallel walls at the mouth of the slot or recess and the flat end at the end of the striker engages between the parallel walls at the end of the recess remote the mouth thereby securing the striker against torsional motion and vertical (up and down) motion of the door in which the latch housing is mounted.

26. A latch housing striker combination for a vehicle door locking mechanism, the latch mechanism as constructed as claimed in claim 10, the striker comprising a head and a base, the head carrying sloping sides tapered in at least one direction from a broad portion towards an apex directed to enter the latch housing, the head of the striker also comprising a flat portion extending in a direction away from the apex away from the broad portion whereby when the striker is secured in the slot and the elastomeric material is compressed at the end of the recess or slot remote the mouth, the broad portion of the tapered portion of the striker engages the parallel walls at the mouth of the slot or recess and the flat end at the end of the striker engages between the parallel walls at the end of the recess remote the mouth thereby securing the striker against torsional motion and vertical (up and down) motion of the door in which the latch housing is mounted.

27. A latch housing striker combination for a vehicle door locking mechanism, the latch mechanism as constructed as claimed in claim 11, the striker comprising a head and a base, the head carrying sloping sides tapered in at least one direction from a broad portion towards an apex directed to enter the latch housing, the head of the striker also comprising a flat portion extending in a direction away from the apex away from the broad portion whereby when the striker is secured in the slot and the elastomeric material is compressed at the end of the recess or slot remote the mouth, the broad portion of the tapered portion of the striker engages the parallel walls at the mouth of the slot or recess and the flat end at the end of the striker engages between the parallel walls at the end of the recess remote the mouth thereby securing the striker against torsional motion and vertical (up and down) motion of the door in which the latch housing is mounted.

28. A latch housing striker combination for a vehicle door locking mechanism, the latch mechanism as constructed as claimed in claim 12, the striker comprising a head and a base, the head carrying sloping sides tapered in at least one direction from a broad portion towards an apex directed to enter the latch housing, the head of the striker also comprising a flat portion extending in a direction away from the apex away from the broad portion whereby when the striker is secured in the slot and the elastomeric material is compressed at the end of the recess or slot remote the mouth, the broad portion of the tapered portion of the striker engages the parallel walls at the mouth of the slot or recess and the flat end at the end of the striker engages between the parallel walls at the end of the recess remote the mouth thereby securing the striker against torsional motion and vertical (up and down) motion of the door in which the latch housing is mounted.

29. A latch housing striker combination for a vehicle door locking mechanism, the latch mechanism as constructed as claimed in claim 13, the striker comprising a head and a base, the head carrying sloping sides tapered in at least one direction from a broad portion towards an apex directed to enter the latch housing, the head of the striker also comprising a flat portion extending in a direction away from the apex away from the broad portion whereby when the striker is secured in the slot, the elastomeric material is compressed at the end of the recess or slot remote the mouth, and the wall proximate the narrower portion to be deflected into a parallel position with the opposite wall is deflected, the broad portion of the tapered portion of the striker engages the parallel walls at the mouth of the slot or recess and the flat end at the end of the striker engages between the parallel walls at the end of the recess remote the mouth thereby securing the striker against torsional motion and vertical (up and down) motion of the door in which the latch housing is mounted.

30. A latch housing striker combination for a vehicle door locking mechanism, the latch mechanism as constructed as claimed in claim 14, the striker comprising a head and a base, the head carrying sloping sides tapered in at least one direction from a broad portion towards an apex directed to enter the latch housing, the head of the striker also comprising a flat portion extending in a direction away from the apex away from the broad portion whereby when the striker is secured in the slot, the elastomeric material is compressed at the end of the recess or slot remote the mouth, and the wall proximate the narrower portion to be deflected into a parallel position with the opposite wall is deflected, the broad portion of the tapered portion of the striker engages the parallel walls at the mouth of the slot or recess and the flat end at the end of the striker engages between the parallel walls at the end of the recess remote the mouth thereby securing the striker against torsional motion and vertical (up and down) motion of the door in which the latch housing is mounted.

31. A latch housing striker combination for a vehicle door locking mechanism, the latch mechanism as constructed as claimed in claim 15, the striker comprising a head and a base, the head carrying sloping sides tapered in at least one direction from a broad portion towards an apex directed to enter the latch housing, the head of the striker also comprising a flat portion extending in a direction away from the apex away from the broad portion whereby when the striker is secured in the slot, the elastomeric material is compressed at the end of the recess or slot remote the mouth, and the wall on the slideable portion is slid to a position parallel and directly opposite the other wall, the broad portion of the tapered portion of the striker engages the parallel walls at the mouth of the slot or recess and the flat end at the end of the striker engages between the parallel walls at the end of the recess remote the mouth thereby securing the striker against torsional motion and vertical (up and down) motion of the door in which the latch housing is mounted.

32. A latch housing striker combination for a vehicle door locking mechanism, the latch mechanism as constructed as claimed in claim 16, the striker comprising a head and a base, the head carrying sloping sides tapered in at least one direction from a broad portion towards an apex directed to enter the latch housing, the head of the striker also comprising a flat portion extending in a direction away from the apex away from the broad portion whereby when the striker is secured in the slot, the elastomeric material is compressed at the end of the recess or slot remote the mouth, and the wall on the slideable portion is slid to a position parallel and directly opposite the other wall, the broad portion of the tapered portion of the striker engages the parallel walls at the mouth of the slot or recess and the flat end at the end of the striker engages between the parallel walls at the end of the recess remote the mouth thereby securing the striker against torsional motion and vertical (up and down) motion of the door in which the latch housing is mounted.

33. The latch housing-striker combination of claim 17, wherein the sloping sides of the head of the striker are tapered in at least two directions towards an apex.

34. The latch housing-striker combination of claim 18, wherein the sloping sides of the head of the striker are tapered in at least two directions towards an apex.

35. The latch housing-striker combination of claim 19, wherein the sloping sides of the head of the striker are tapered in at least two directions towards an apex.

36. The latch housing-striker combination of claim 20, wherein the sloping sides of the head of the striker are tapered in at least two directions towards an apex.

37. The latch housing-striker combination of claim 21, wherein the sloping sides of the head of the striker are tapered in at least two directions towards an apex.

38. The latch housing-striker combination of claim 22, wherein the sloping sides of the head of the striker are tapered in at least two directions towards an apex.

39. The latch housing-striker combination of claim 23, wherein the sloping sides of the head of the striker are tapered in at least two directions towards an apex.

40. The latch housing-striker combination of claim 24, wherein the sloping sides of the head of the striker are tapered in at least two directions towards an apex.

41. The latch housing-striker combination of claim 25, wherein the sloping sides of the head of the striker are tapered in at least two directions towards an apex.

42. The latch housing-striker combination of claim 26, wherein the sloping sides of the head of the striker are tapered in at least two directions towards an apex.

43. The latch housing-striker combination of claim 27, wherein the sloping sides of the head of the striker are tapered in at least two directions towards an apex.

44. The latch housing-striker combination of claim 28, wherein the sloping sides of the head of the striker are tapered in at least two directions towards an apex.

45. The latch housing-striker combination of claim 29, wherein the sloping sides of the head of the striker are tapered in at least two directions towards an apex.

46. The latch housing-striker combination of claim 30, wherein the sloping sides of the head of the striker are tapered in at least two directions towards an apex.

47. The latch housing-striker combination of claim 31, wherein the sloping sides of the head of the striker are tapered in at least two directions towards an apex.

48. The latch housing-striker combination of claim 32, wherein the sloping sides of the head of the striker are tapered in at least two directions towards an apex.

49. The latch housing-striker combination of claim 17, 18 or 19, wherein the striker comprises two rectangular portions each having two opposed end edges carrying a mounting aperture and a latch-receiving aperture for receiving a latch, the two rectangular portions each being bent intermediate their end edges and disposed normal (substantially 90 degrees) to one another, the portion between the edge of the latch-receiving aperture remote the bent and closed end edge to the latch-receiving aperture is curved laterally in a direction away from the plane of the bent portion containing the latch-receiving aperture in a direction towards the portion containing the mounting aperture whereby when the two portions containing the latch-receiving aperture are aligned and joined together, the end of the striker provides two laterally-extending curved portions tapered towards an apex directed for centering a latch housing.

50. The latch housing-striker combination of claim 17, 18 or 19, wherein the striker comprises a U-shape member, comprising a pair of legs anchored to the base, the head comprising a connector for connecting the legs, the connector comprising the tapered portions.

* * * * *